US005730945A

United States Patent [19]

Klobucar

[11] Patent Number: 5,730,945

[45] Date of Patent: Mar. 24, 1998

[54] PURGE RETENTION CHAMBER INCORPORATED INTO RTO INLET MANIFOLD

[75] Inventor: Joseph M. Klobucar, Plymouth, Mich.

[73] Assignee: Durr Environmental, Inc., Plymouth, Mich.

[21] Appl. No.: 613,468

[22] Filed: Mar. 11, 1996

[51] Int. Cl.[6] ..... F01N 3/10

[52] U.S. Cl. ..... 422/173; 422/175; 422/178; 422/223; 432/170; 432/181

[58] Field of Search ..... 422/173, 175, 422/178, 223; 432/181; 431/170

[56] References Cited

U.S. PATENT DOCUMENTS

| | | | |
|---|---|---|---|
| 5,184,951 | 2/1993 | Nutcher et al. | 432/28 |
| 5,293,827 | 3/1994 | Nester et al. | 110/304 |
| 5,346,393 | 9/1994 | D'Souza | 432/179 |
| 5,365,863 | 11/1994 | D'Souza | 110/211 |
| 5,376,340 | 12/1994 | Bayer et al. | 422/175 |
| 5,453,259 | 9/1995 | D'Souza | 423/245.1 |
| 5,567,229 | 10/1996 | Klobucar et al. | 95/113 |
| 5,578,276 | 11/1996 | Klobucar | 422/173 |

OTHER PUBLICATIONS

PCT International Application, Publication Number WO 91/00477, Application No. PCT/SE90/00453, Filing Date: Jun. 25, 1990. Entitled: A Method and a Device in Gas Purifying Installations for Preventing Discharge of Unpurified Gas Upon Changes of the Gas-Flow Direction.

*Primary Examiner*—Nina Bhat

*Attorney, Agent, or Firm*—Howard & Howard

[57] ABSTRACT

A purge retention chamber is incorporated into an inlet manifold for a two heat exchanger RTO system. A bypass valve is mounted into the purge retention chamber adjacent a downstream end, and a purge face valve is mounted in the inlet manifold between upstream and downstream connection ends of the purge retention chamber. During normal operation, the bypass valve is closed and clean air fills the purge retention chamber. Dirty air to be cleaned passes through the purge face valve and moves to a heat exchanger in an inlet mode. When a purge mode begins, the purge face valve is closed and the purge bypass valve is opened. Now, clean purge gas moves into the inlet manifold and is delivered to a heat exchanger which is beginning to switch from an inlet mode to an outlet mode. The clean purge gas purges the heat exchanger. Once the purging is complete, the heat exchangers are switched between inlet and outlet modes. Preferably, after the inlet/outlet valve switch has occurred, the purge bypass and purge face valve switch back and the system returns to normal operation delivering dirty gas to be cleaned to the heat exchanger that is now in an inlet mode.

12 Claims, 4 Drawing Sheets

PURGE RETENTION CHAMBER INCORPORATED INTO RTO INLET MANIFOLD

BACKGROUND OF THE INVENTION

This invention relates to a unique purge retention chamber that has particular application in regenerative thermal oxidizers with two heat exchangers.

Regenerative thermal oxidizers are used in the prior art to remove impurities or pollutants from an industrial gas stream. In one example, an air stream containing pollutants, such as the volatile organic compounds found in air from a paint spray booth, is directed into a regenerative thermal oxidizer ("RTO"). The RTO removes the impurities from the air stream by combustion. There are typically at least two heat exchangers, with a first heat exchanger receiving a pollutant-laden cool gas to be cleaned, or a "dirty" gas. The dirty gas passes through the heat exchanger into the combustion chamber. The second heat exchanger is receiving a hot clean gas from the combustion chamber. Air moves from the first heat exchanger and into the combustion chamber, and from the combustion chamber into the second heat exchanger.

The air leaving the combustion chamber is quite hot, and heats the second combustion chamber. At the same time, the air entering through the first heat exchanger is heated by the first heat exchanger. After a period of time, the valves associated with the two heat exchangers are switched such that the first heat exchanger, which had been previously been heating the cool gas, again receives the hot combusted gas. The second heat exchanger, which had been receiving the hot combusted gas, now receives the cool dirty gas. The cool dirty gas now passes over the previously heated second heat exchanger and is preheated prior to reaching the combustion chamber. This preheating improves the efficiency of the system. This cyclic process is repeated as the RTO continuously and efficiently removes impurities from a high volume industrial gas stream.

The outlet passage of an RTO is typically directed back to atmosphere. Thus, strict controls are necessary to insure that no "dirty" gas reaches the atmosphere. When each heat exchanger is initially switched from being in an inlet mode, where it receives dirty gas, to being in the outlet mode where it receives the clean gas, there may be residual dirty gas remaining. To address this problem, RTOs have been provided with a third heat exchanger. The third heat exchanger operates in a purge mode to drive residual dirty gas from the heat exchanger prior to the heat exchanger moving to the outlet mode.

In some cases it might be desirable to have an RTO system with only two heat exchangers. A purge function would still be desirable to minimize the flow of dirty gas to the atmosphere. Typically, the incorporation of a purge cycle into a two heat exchanger RTO has required a break in the flow of gas from the source of dirty gas while the purge drives residual air from the heat exchanger. It is the goal of any RTO system to maximize the volume of gas that is cleaned and to provide continuous processing. Providing a break between the inlet and outlet modes undesirably decreases the volume. Also, it is desirable to process dirty gas continuously, and move the dirty gas from the industrial source to the RTO system continuously. There have been some efforts to develop an RTO system wherein two heat exchangers are provided with a purge function. In one proposal, a single rotary valve alternately connects two heat exchangers to an inlet and an outlet passage. The inlet passage is alternately connected to the dirty gas, or to a clean purge gas. The single rotary valve must fully separate the inlet and outlet passages. The operation of this system is such that the single rotary valve would have to be controlled extremely accurately to prevent communication of dirty gas to the outlet passage. Even with careful control, leakage of dirty gas to the outlet is a possibility. As such, this proposed system does not achieve the goal of a practical purge cycle for a two heat exchanger RTO system.

SUMMARY OF THE INVENTION

In a disclosed embodiment of this invention, a purge retention chamber is incorporated into an inlet manifold for a two heat exchanger RTO system. The purge retention chamber has a first end incorporated into the inlet manifold at an upstream location and a second end incorporated at a downstream location on the inlet manifold. A purge bypass valve is incorporated into the retention chamber adjacent to the second end. A purge face valve is incorporated into the inlet manifold between the points where the inlet manifold communicate with the two ends of the purge retention chamber. A source of clean purge air is communicated to the purge retention chamber upstream of the purge bypass valve.

During typical operation of the RTO system, clean purge air is communicated to the purge retention chamber. The purge bypass valve is closed, and the purge face valve is open. Dirty air passes through the inlet valve and into one of the two heat exchangers. At the same time, clean gas passes through the other heat exchanger.

When it becomes time to switch the two heat exchangers between the inlet and outlet mode, the purge bypass valve is opened, and the purge face valve is closed. Dirty air continues to move into the inlet manifold, but now enters the first end of the purge retention chamber. The dirty air drives the clean purge air outwardly of the second end of the purge retention chamber, and into the inlet manifold. The clean purge air moves through the inlet manifold, and into the heat exchanger which is to be switched from the inlet mode to the outlet mode. The heat exchanger is purged by this clean air. After a period of time, the clean air within the purge retention chamber begins to be depleted. At about the time dirty air passes the purge bypass valve, the heat exchanger inlet and outlet valves are switched. That is, the heat exchanger which is being switched to the outlet mode has its inlet valve closed and its outlet valve opened. Since this heat exchanger has been purged by the clean purge air, no dirty gas will escape to atmosphere. The dirty gas which has now moved into the inlet manifold from the purge retention chamber is driven into the inlet of the second heat exchanger, which is now just beginning its inlet mode. Since the purge bypass valve is spaced by some distance from the heat exchangers, there is little likelihood that the dirty gas will have reached the inlet line of the heat exchangers prior to the inlet and outlet valves switching.

It is preferred that the purge bypass valve and purge face valve switch back to non-purging positions after the heat exchanger valves switch. This will increase the efficiency of the system, and further insure that little dirty gas is likely to be exhausted to atmosphere. Once the bypass and face purge valves have switched back to their normal position, the purge retention chamber is again filled with clean purge air.

The present invention discloses a method and apparatus for achieving this high efficiency, reliable purging of two heat exchanger RTO systems. Features and specifics of the apparatus and method will be best understood from the following specification and drawings, of which the following is a brief description.

DETAILED DESCRIPTION OF A PREFERRED EMBODIMENT

Figure 1:
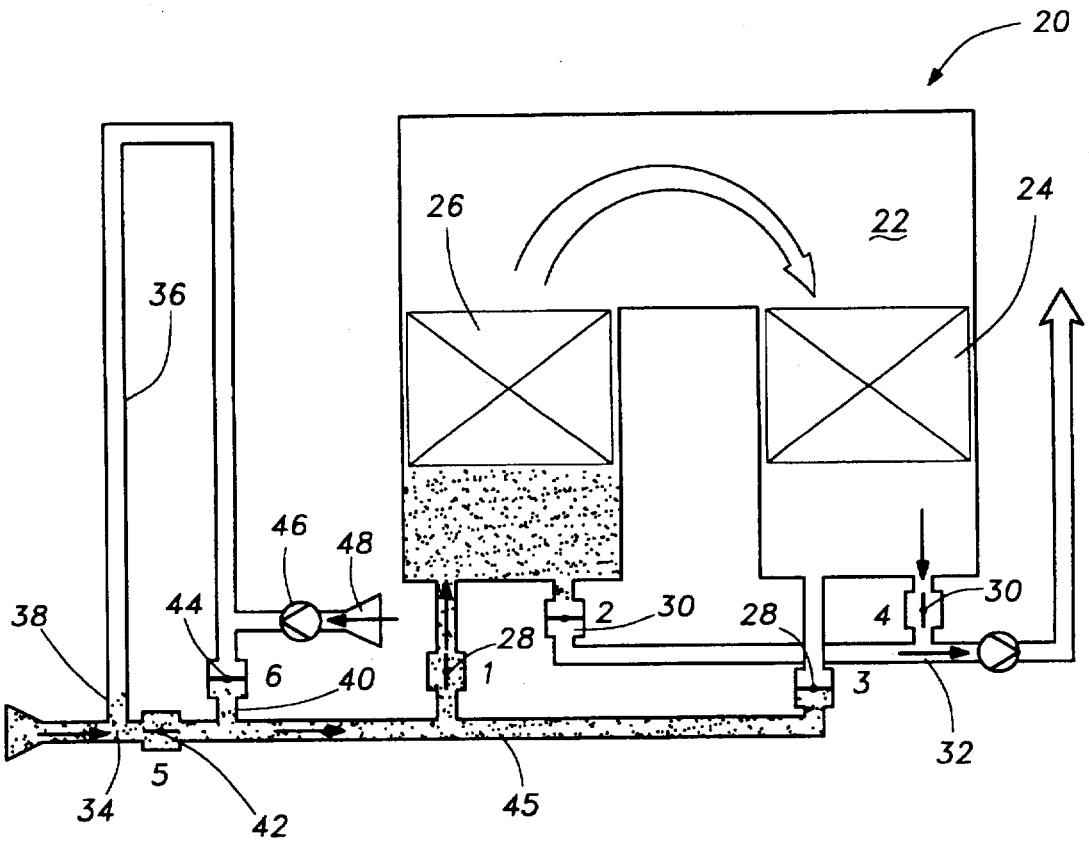
FIG. 1 shows a RTO system prior to beginning of a purge cycle.

FIG. 1 shows a RTO system 20 incorporating a standard combustion chamber 22, and two regenerative heat exchangers 24 and 26. Each of the heat exchangers has an inlet line passing through an inlet valve 28, and an outlet line passing through an outlet valve 30 to an outlet manifold 32.

FIG. 1 shows the system in its normal operational mode. Dirty air passes through an inlet manifold 34, into the inlet line having an open inlet valve 28 (here heat exchanger 26), into combustion chamber 22, and then through heat exchanger 24, outlet valve 30, and into outlet manifold 32. Clean gas in outlet manifold 32 is then delivered to atmosphere. The dirty gas is illustrated by dots, and fills the heat exchanger 26 at the portion of the cycle shown in FIG. 1. If the heat exchanger 26 were immediately switched to the outlet mode, the dirty gas trapped in the heat exchanger 26 would be delivered through the outlet manifold 32. This would be undesirable.

Thus, a purge system is incorporated into the RTO 20. A purge retention chamber 36 has a first upstream end 38 communicating with the inlet manifold 34, and a second downstream end 40 also communicating with the inlet manifold 34. A purge face valve 42 is mounted in the inlet manifold 34 between the ends 38 and 40. A purge bypass valve 44 is incorporated into the purge retention chamber 36 adjacent second end 40. A purge fan 46 delivers air from a purge air source 48. Purge air source 48 may be clean atmospheric air, or could be air from the outlet manifold 32. Depending on the relative operating pressures, purge fan 46 may not be necessary.

After a period of time with RTO 20 operating as shown in FIG. 1, it will be desirable to shift the heat exchanger 26 to its outlet mode. In FIG. 1, purge face valve 42 is opened and purge bypass valve 44 is closed. Clean purge air fills the purge retention chamber 36, and dirty gas passes through the inlet manifold 34 to the heat exchanger 26.

Figure 2:
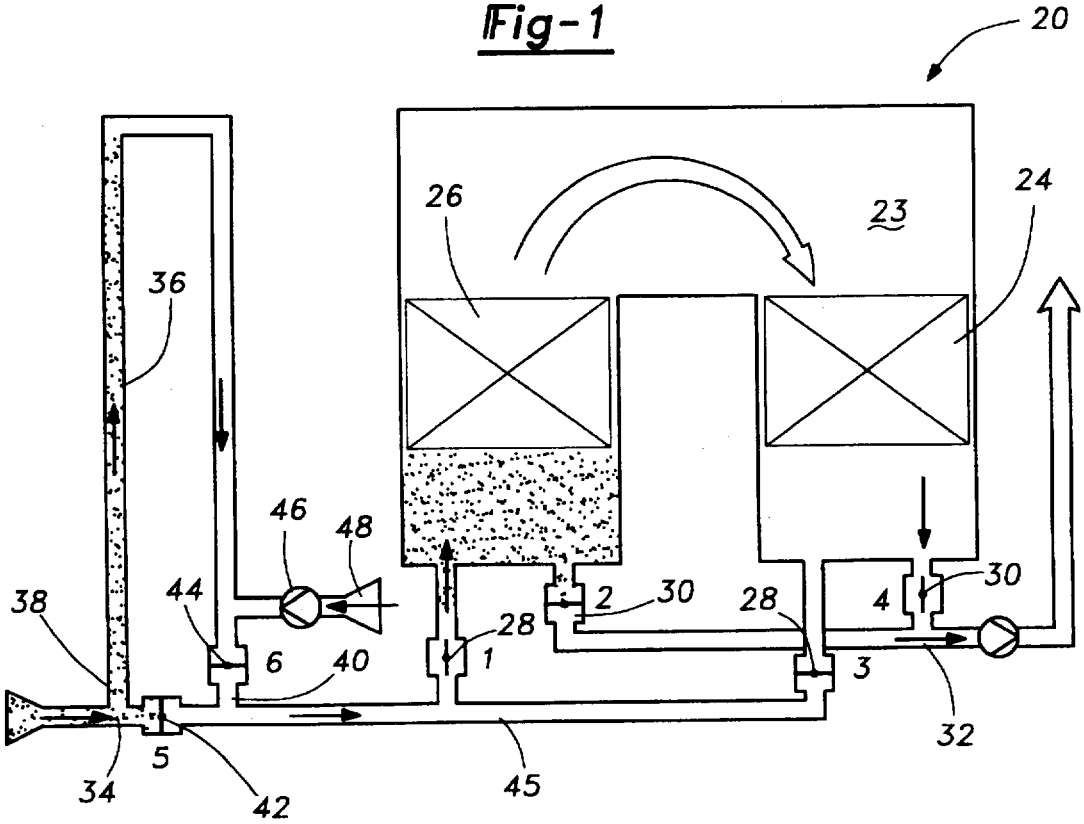
FIG. 2 shows the first step in beginning the purge cycle.

As shown in FIG. 2, the initial step in moving to a purge cycle is to close purge face valve 42 and open purge bypass valve 44. Now, the dirty gas in inlet manifold 34 moves into purge retention chamber 36, and drives the clean gas through valve 44 into a portion 45 of the inlet manifold downstream of second end 40. The clean gas now passes through the inlet valve 28, and purges the heat exchanger 26.

Figure 3:
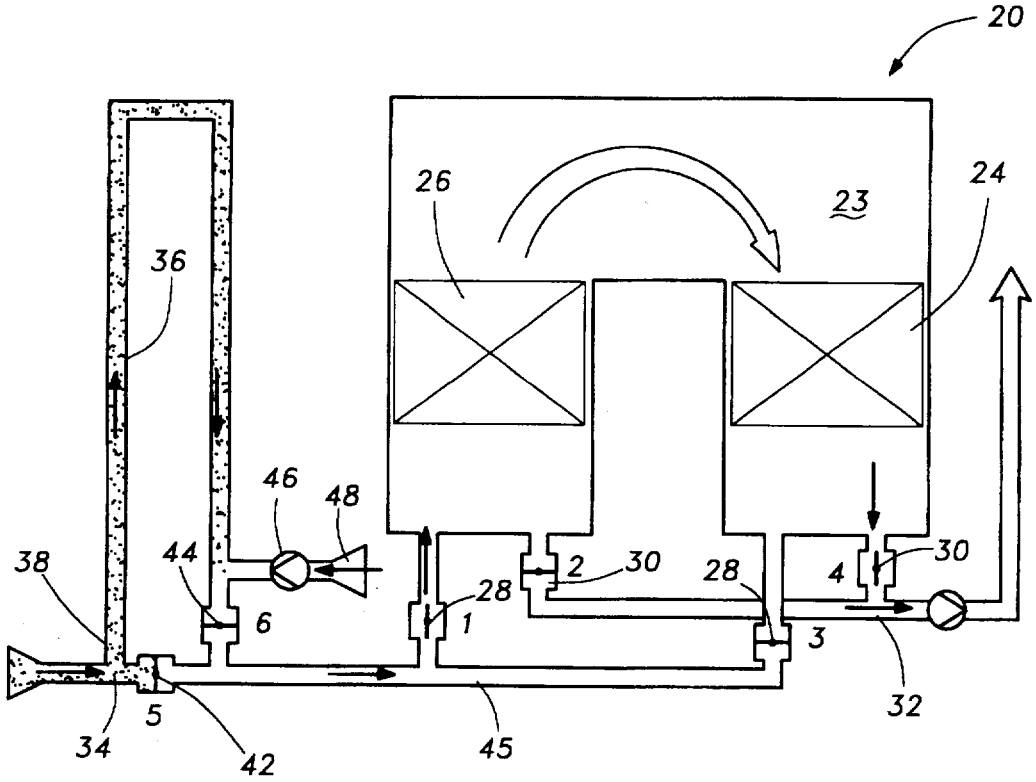
FIG. 3 shows a subsequent step.

FIG. 3 shows a step subsequent to that shown in FIG. 2. The dirty gas entering purge retention chamber 36 from end 38 is approaching the purge bypass valve 44. Still, the air in portion 45 is all clean purge air. As shown in FIG. 3, the heat exchanger 26 has now been fully purged.

Figure 4:
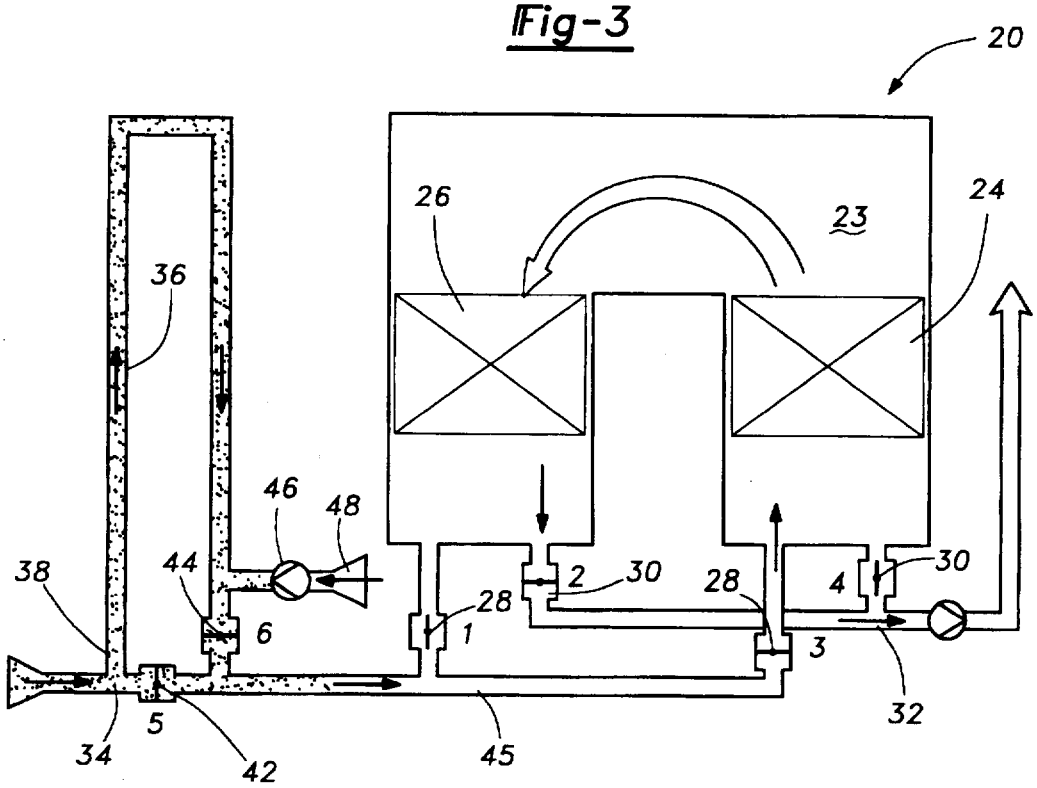
FIG. 4 shows another subsequent step.

As shown in FIG. 4, the purge valves 42 and 44 retain the position shown in FIGS. 3 and 2, but the inlet valve 28 on heat exchanger 26 has now closed, and the outlet valve 30 has opened. At the same time, inlet valve 28 on heat exchanger 24 has opened and outlet valve 30 has closed. Heat exchanger 24 is now beginning its inlet mode while heat exchanger 26 has begun its outlet mode. Due to the portion 45 between the second end 40 and the inlet valves 28, there is a "margin of error" that does not require the valves 42 and 44 to be precisely controlled. The switching of valves 28 and 30 occurs while only clean purge air is in the portion 45 adjacent to the valves 28. Thus, there is little likelihood of dirty gas leaking to the atmosphere.

Figure 5:
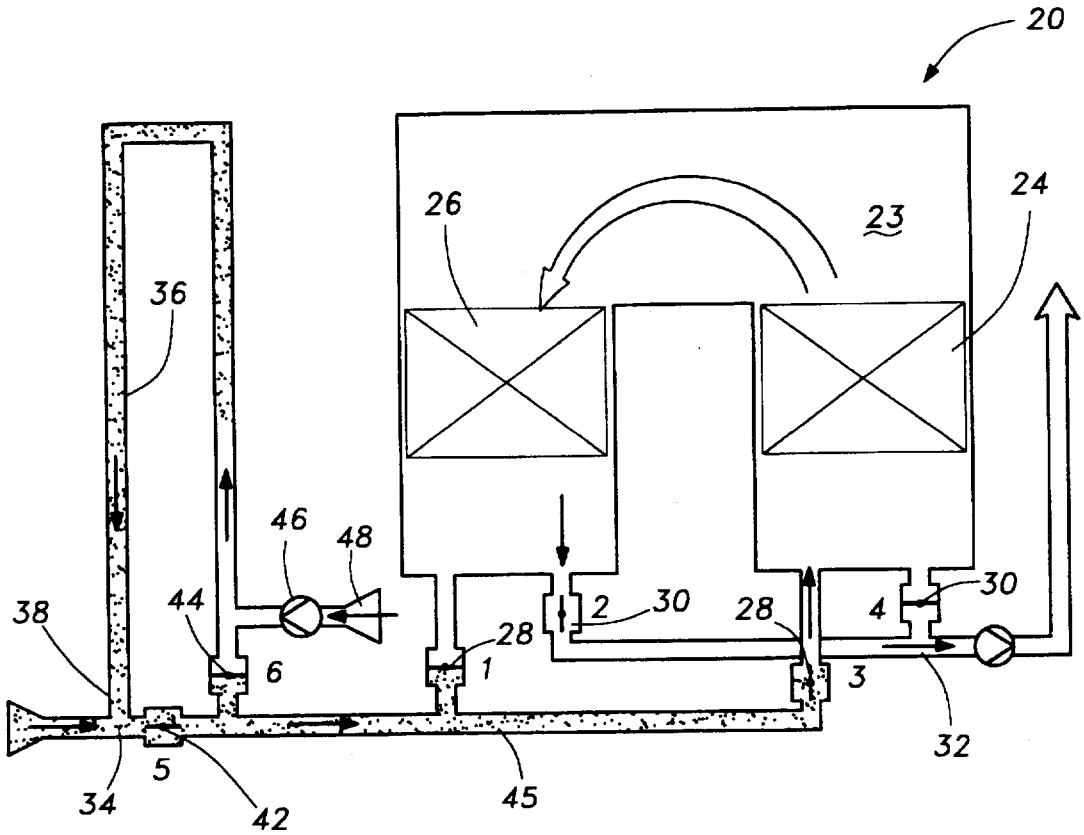
FIG. 5 shows the first step in preparing for the next purge cycle.

As shown in FIG. 5, the valve 42 has opened and valve 44 has closed. The sole portion of the purge cycle that remains is to replenish the retention chamber 36 with clean purge air to prepare for the next purge cycle. As shown, clean air is delivered from line 48 through purge fan 46 into the retention chamber 36, driving the remaining dirty gas into the inlet manifold 34 through end 38.

Figure 6:
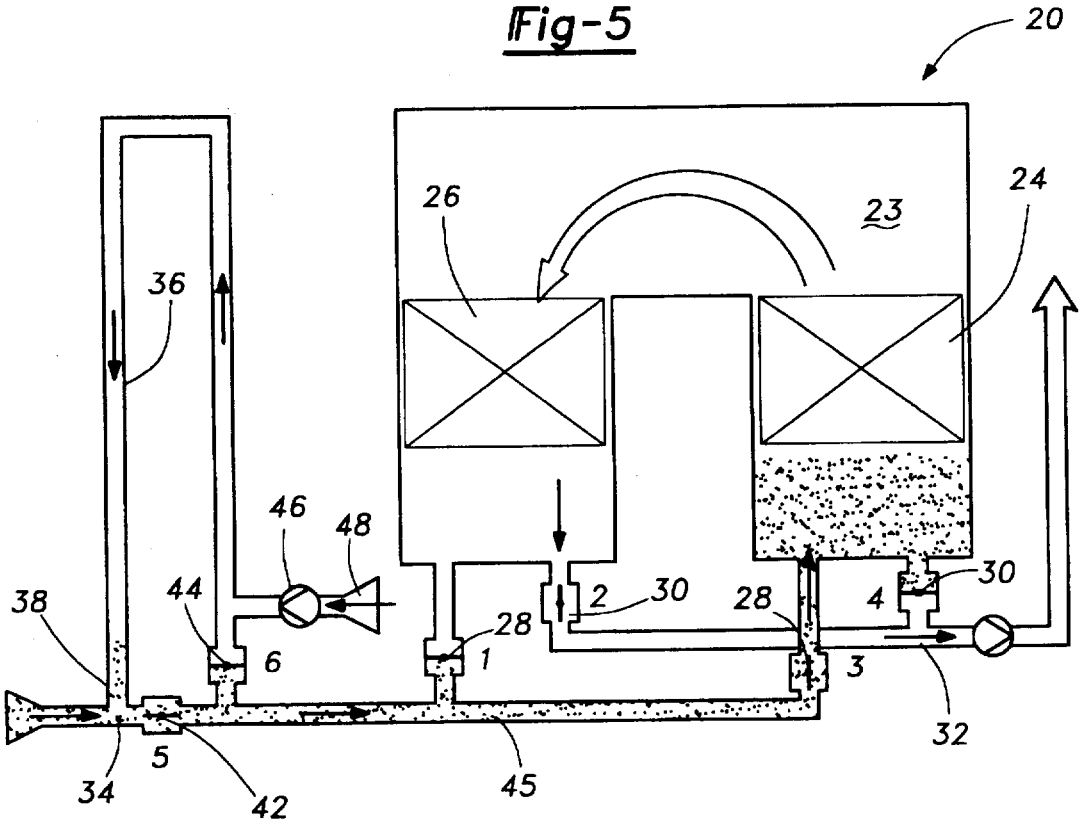
FIG. 6 shows the system again operating under normal conditions while awaiting the next purge cycle.
Figure 7:
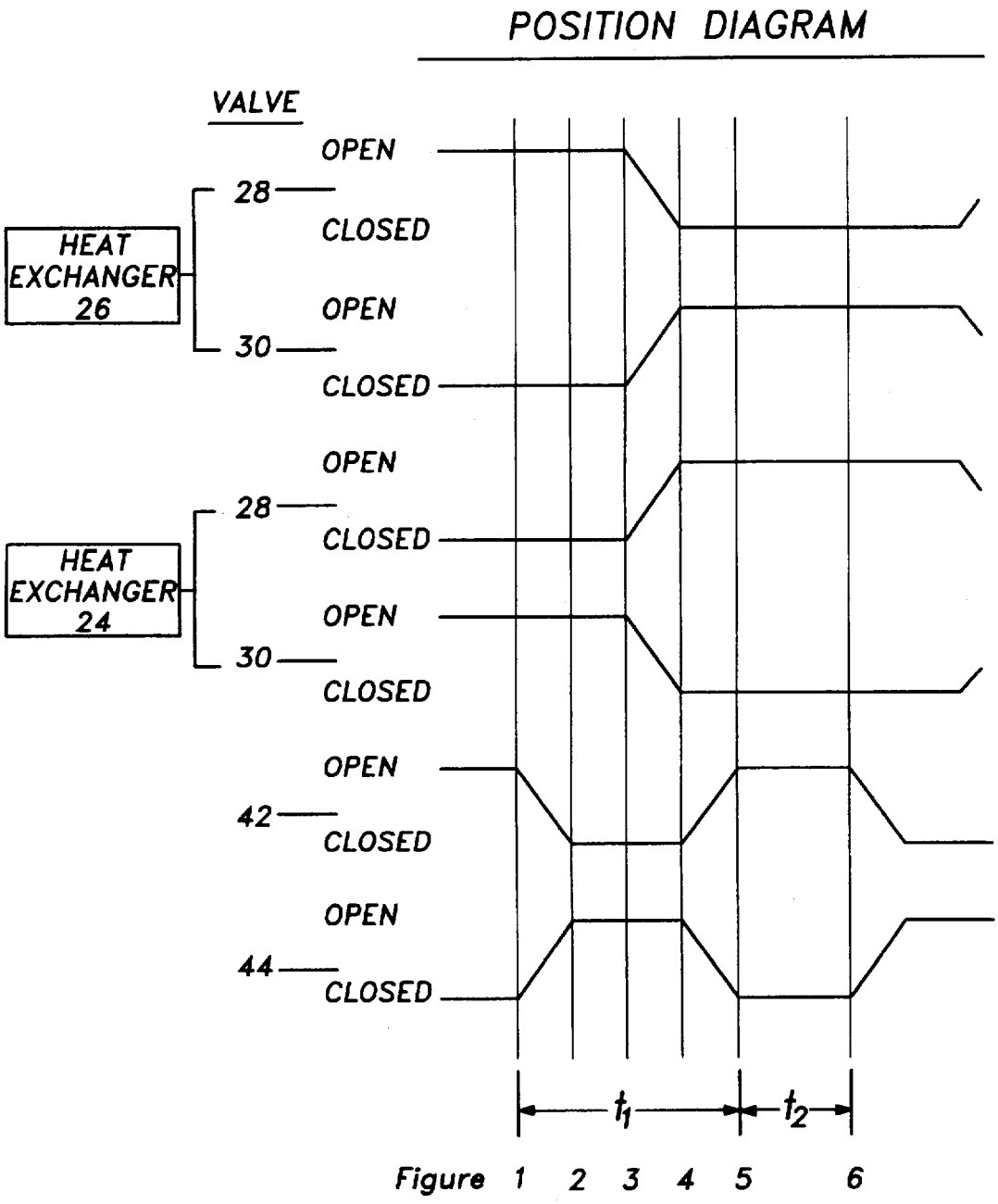
FIG. 7 is a valve timing chart relative to FIGS. 1–6.
Figure 3:
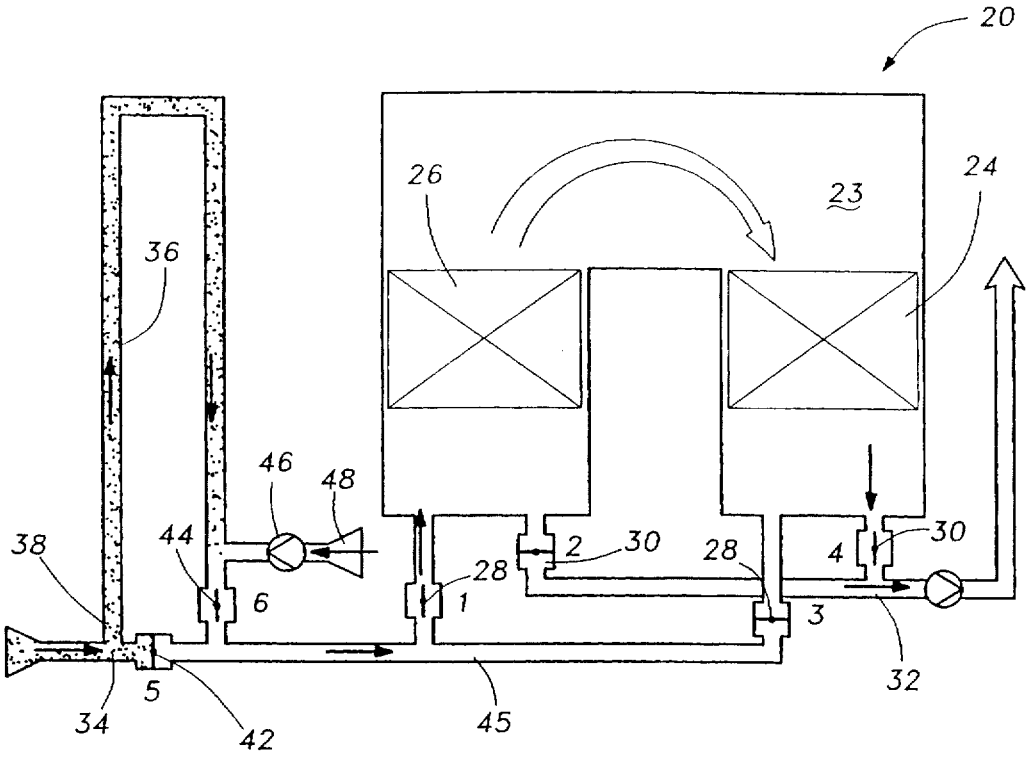
Figure 4:
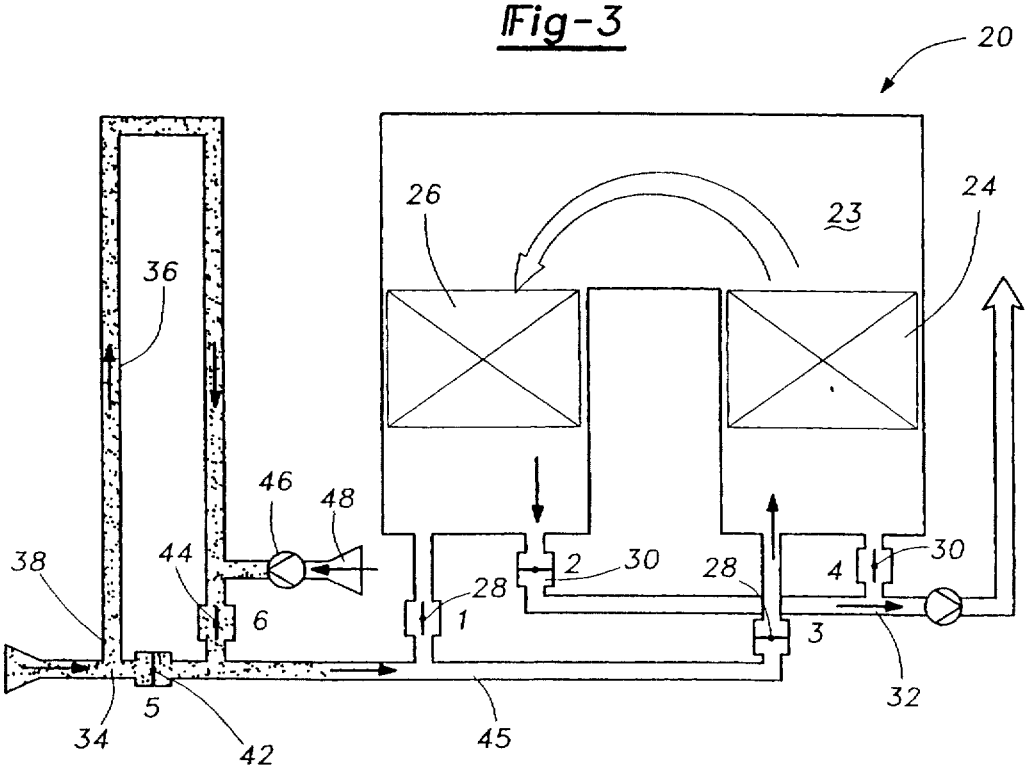
Figure 1:
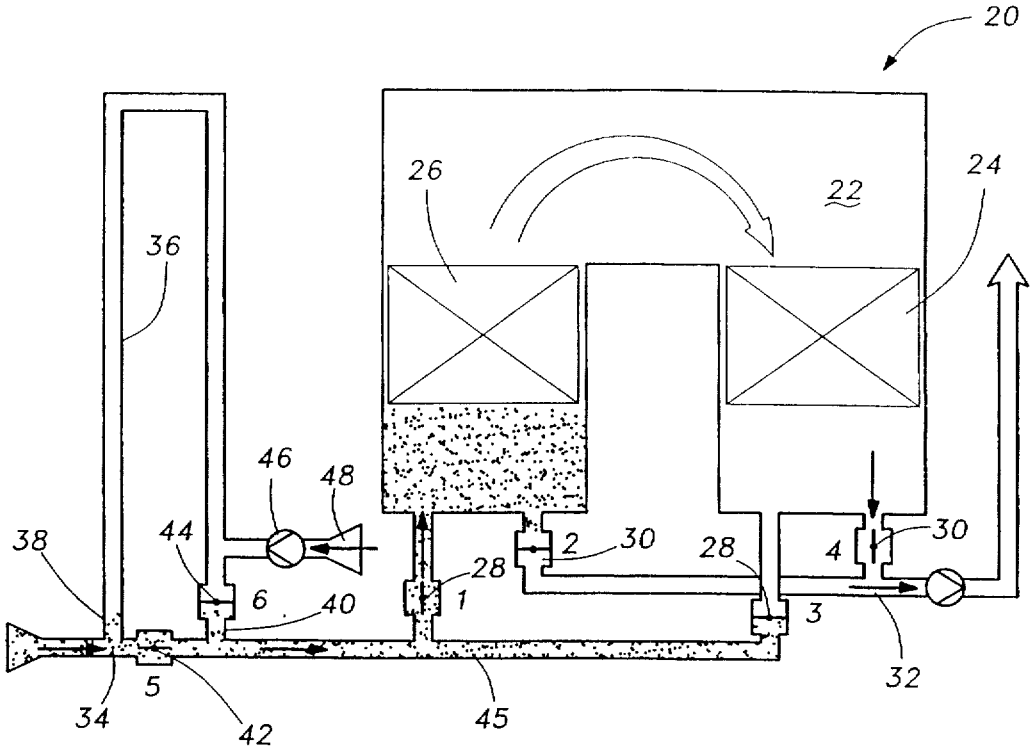
Figure 2:
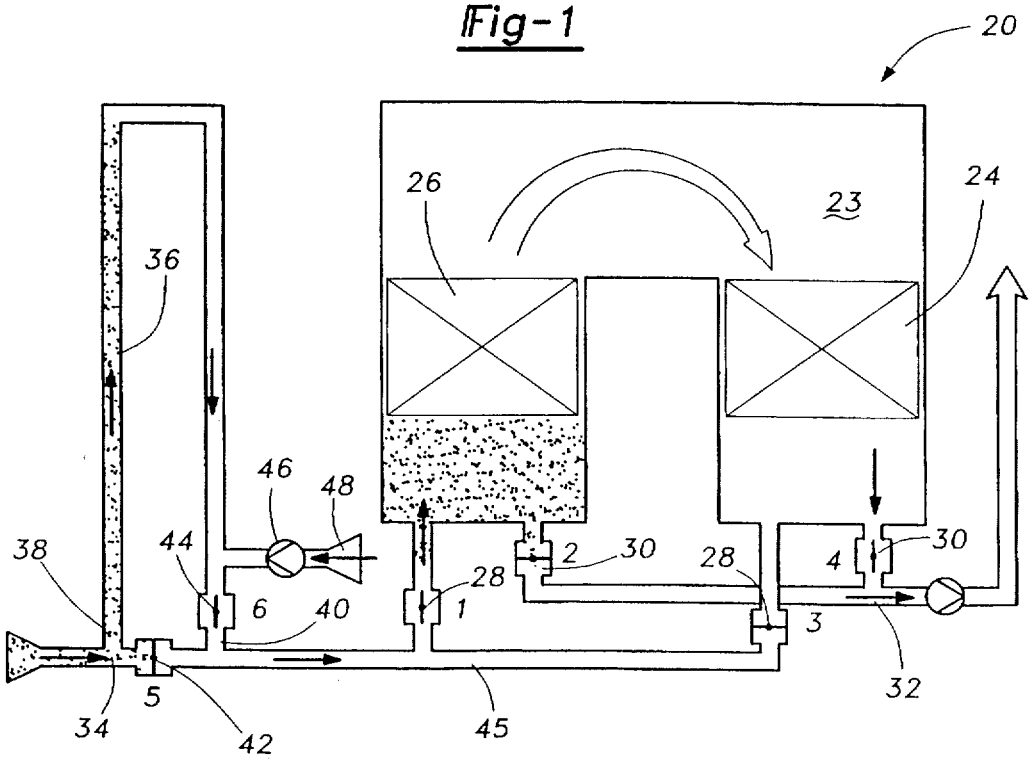

As shown in FIG. 6, the cycle has now switched between the heat exchangers, and the RTO 20 is operating in a non-purge mode. Eventually, the heat exchangers will switch back between the inlet and outlet modes. A purge cycle as described above will occur before that switch. FIG. 7 is a valve timing chart that shows the preferred relative opening and closing times for the system valves.

A preferred embodiment of this invention has been disclosed, however, a worker of ordinary skill in the art would recognize that certain modifications would come within the scope of this invention. For that reason, the following claims should be studied to determine the true scope and content of this invention.

I claim:

1. An RTO system comprising:

a combustion area communicating with at least two heat exchangers;

each of said heat exchangers communicating with an inlet line and an outlet line, an inlet manifold communicating with said inlet lines of both said heat exchangers and an outlet manifold communicating with said outlet lines of both said heat exchangers;

an inlet valve mounted on each said inlet line and an outlet valve mounted on each said outlet line; and a purge retention chamber having two ends communicating into said inlet manifold, with an upstream end and a downstream end, and a valve system for selectively delivering clean purge air from said purge retention chamber into said inlet manifold during a purge cycle.

2. An RTO system as recited in claim 1, wherein said valve system incorporates a first valve mounted on said inlet manifold between said two ends of said purge retention chamber, and a second valve mounted in said purge retention chamber adjacent said downstream end, and a source of clean purge air being connected into said purge retention chamber between said upstream end and said second valve.

3. An RTO system as recited in claim 2, wherein there are only two of said heat exchangers.

4. An RTO system as recited in claim 1, wherein said inlet and outlet valves are separate valves.

5. An RTO system comprising:

a combustion area communicating with at least two heat exchangers;

each of said heat exchangers communicating with an inlet line and an outlet line, an inlet manifold communicating with said inlet lines of both said heat exchangers and an outlet manifold communicating with said outlet lines of both said heat exchangers;

an inlet valve mounted on each said inlet line and an outlet valve mounted on each said outlet line; and a purge retention chamber having two ends communicating into said inlet manifold, with an upstream end and a downstream end, a first valve mounted on said inlet manifold between said two ends of said purge retention chamber, and a second valve mounted in said purge retention chamber adjacent said downstream end, and a source of clean purge air being connected into said purge retention chamber between said upstream end and said second valve.

6. An RTO system as recited in claim 5, wherein there are only two of said heat exchangers.

7. An RTO system as recited in claim 5, wherein a purge fan delivers said source of purge air into said purge retention chamber.

8. An RTO system as recited in claim 5, wherein said inlet and outlet valves are separate valves.

9. A method of operating a two heat exchanger RTO system comprising the steps of:

(1) providing at least two heat exchangers communicating with a combustion area, providing each of said heat exchangers with an inlet line and an outlet line, providing inlet valves on each said inlet line and outlet valves each said outlet line, providing a purge retention chamber communicating with an inlet manifold that communicates with each said inlet line, and providing a valve system for selectively communicating clean purge air from said purge retention chamber into said inlet manifold;

(2) opening an outlet valve on a first said heat exchanger and closing its inlet valve, opening the inlet valve on a second said heat exchanger and closing its outlet valve;

(3) delivering dirty gas to be cleaned to said inlet manifold, passing said dirty gas through said second heat exchanger and into said combustion chamber, and delivering clean gas from said combustion chamber through said first heat exchanger;

(4) beginning a purge cycle by opening said valve system to deliver clean purge gas from said purge retention chamber into said inlet manifold, and delivering said clean purge gas through said second heat exchanger;

(5) switching the inlet and outlet valves on said two heat exchangers; and (6) changing said valve system to again deliver dirty gas to be cleaned to said inlet manifold.

10. A method as recited in claim 9, wherein said valve system includes a first valve mounted in said inlet manifold between said two ends of said purge retention chamber and a second valve mounted adjacent said second end of said purge retention chamber, said first valve being opened during steps (3) and (6) with said second valve being closed, and said first valve being closed and said second valve being opened during steps (4) and (5).

11. A method as recited in claim 10, wherein step (6) occurs after step (5).

12. A method as recited in claim 9, wherein step (6) occurs after step (5).

* * * * *

UNITED STATES PATENT AND TRADEMARK OFFICE

CERTIFICATE OF CORRECTION

PATENT NO : 5,730,945

DATED : 03/24/98

INVENTOR(S) : Joseph M. Klobucar

It is certified that error appears in the above-identified patent and that said Letters Patent is hereby corrected as shown below:

The drawing sheet 2,3,4, consisting of Figs. 2,3,4,should be deleted to be replaced with the drawing sheets, consisting of Figs. 2,3,4, as shown on the attached page.

Signed and Sealed this

Fifteenth Day of June, 1999

*Attest:*

Q. TODD DICKINSON

*Attesting Officer*

*Acting Commissioner of Patents and Trademarks*